US005492049A

United States Patent [19]

Aoki et al.

[11] Patent Number: 5,492,049

[45] Date of Patent: Feb. 20, 1996

[54] AUTOMATIC ARRANGEMENT DEVICE CAPABLE OF EASILY MAKING MUSIC PIECE BEGINNING WITH UP-BEAT

[75] Inventors: Eiichiro Aoki; Kazunori Maruyama, both of Hamamatsu, Japan

[73] Assignee: Yamaha Corporation, Japan

[21] Appl. No.: 275,139

[22] Filed: Jul. 14, 1994

[30] Foreign Application Priority Data

Jul. 16, 1993 [JP] Japan ..... 5-198888

[51] Int. Cl.[6] ..... G10H 1/26; G10H 1/40

[52] U.S. Cl. ..... 84/611; 84/635; 84/DIG. 12

[58] Field of Search ..... 84/609–614, 634–638, 84/DIG. 12, DIG. 22

[56] References Cited

U.S. PATENT DOCUMENTS 5,369,216 11/1994 Miyamoto ..... 84/609

FOREIGN PATENT DOCUMENTS 4-234090 8/1992 Japan .

*Primary Examiner*—Stanley J. Witkowski

*Attorney, Agent, or Firm*—Graham & James

[57] ABSTRACT

In a pattern memory are stored plural performance patterns, each of which has one or more measures. Plural ones of the performance patterns are optionally selected and read out from the pattern memory, so as to make a music piece made up of time-series combinations of the selected performance patterns. The thus-made music piece is stored into a song memory. A suitable device such as a switch or a detector or a suitable process is employed to instruct to make a music piece in auftakt form. For this purpose, such a method may be employed, for instance, where it is detected that the melody part is in the form of an auftakt music piece, and in response to this detection, it is automatically instructed that the music piece made up of combinations of the performance patters should also be made in auftakt form. In accordance with this instruction, a part of a certain one-measure (last-measure, for example) performance pattern is read out from the pattern memory, and the read-out part of the one-measure performance pattern is added as an auftakt pattern to the beginning of the music piece to be made.

12 Claims, 8 Drawing Sheets

SONG FORMATION

| SONG No.3 | | | | |
|---|---|---|---|---|
| SECTION | A | B | C | D |
| NUMBER OF MEASURES | 4 | 4 | 4 | 8 |
| STYLE | 3 | 5 | 2 | 4 |

AUTOMATIC ARRANGEMENT DEVICE CAPABLE OF EASILY MAKING MUSIC PIECE BEGINNING WITH UP-BEAT

BACKGROUND OF THE INVENTION

This invention relates to automatic arrangement devices which make a music piece by reading out previously stored performance patterns of plural measures and combining the read-out patterns in a time-series fashion. This invention relates more particularly to automatic arrangement devices which can make or compose a music piece beginning with up-beat (hereinafter referred to as an auftakt music piece), in response to instruction to start making a music piece halfway within a measure, employing a part of a predetermined one-measure performance pattern as auftakt data.

Among automatic arrangement devices, there has been conventionally known such a device where various kinds of automatic performance patterns of one or more measures are previously stored in a pattern memory so that desired ones of the patterns are selectively read out, and time-series combinations of the read-out patterns are then stored in a performance memory as music piece data. Such an automatic arrangement device is disclosed in, for example, U.S. patent application Ser. No. 08/23,485 that corresponds to Japanese Patent Laid-open Publication No. HEI 4-234090.

According to the above-mentioned prior art arrangement device, the performance patterns are combined measure by measure, and thus it is not possible to selectively take out part of the performance pattern for making a music piece halfway within a measure.

Summary of the Invention

It is therefore an object of the present invention to provide a novel automatic arrangement device which is capable of making an auftakt music piece with utmost ease.

It is another object of the present invention to provide an automatic arrangement device which is capable of achieving arrangement full of variety.

In order to accomplish the above-mentioned objects, an automatic arrangement device comprises a pattern storage section for storing plural different performance patterns, each of the performance patterns being of one or more measures, a composition section for selecting and reading out desired ones of the performance patterns from the pattern storage means to thereby make a music piece comprising time-series combinations of the selected performance patterns, an instruction section for instructing to make the music piece in the form of an auftakt music piece form, and an auftakt pattern addition section for, in accordance with instruction from the instruction section, reading out a part of a one-measure performance pattern from the pattern storage section and adding the read-out part of the one-measure performance pattern to the beginning of the music piece to be made by the composition section.

With the automatic arrangement device thus constructed, once the instruction section has instructed to make a music piece in auftakt form, a part of a certain one-measure performance pattern is read out from the pattern storage section, and the read-out part of the one-measure pattern is added, as an auftakt pattern, to the beginning to a music piece to be made by the composition section. Thus, it allowed to freely conduct arrangement/composition for making an auftakt music piece without the necessity to previously store patterns dedicated to an auftakt music piece.

In accordance with one preferred embodiment mode of the present invention, the arrangement device may include a section for providing performance data for a melody part, so that it is detected, on the basis of the provided melody-part performance data, that the melody starts in auftakt form, and addition of an auftakt pattern by the addition section is automatically made in accordance with such detection. Further, as another preferred embodiment mode, a part of a last-measure performance pattern of those patterns selected for arrangement/composition may be read out from the pattern storage section, and the read-out part of the last-measure performance may be added as the auftakt patter.

The term "auftakt music piece" as used herein signifies such a music piece that begins with an up-beat portion, i.e., a beat other than a first beat in a measure.

Now, the preferred embodiment of the present invention will be described with reference to the accompanying drawings.

DETAILED DESCRIPTION OF THE PREFERRED EMBODIMENT

Figures 1, 2:
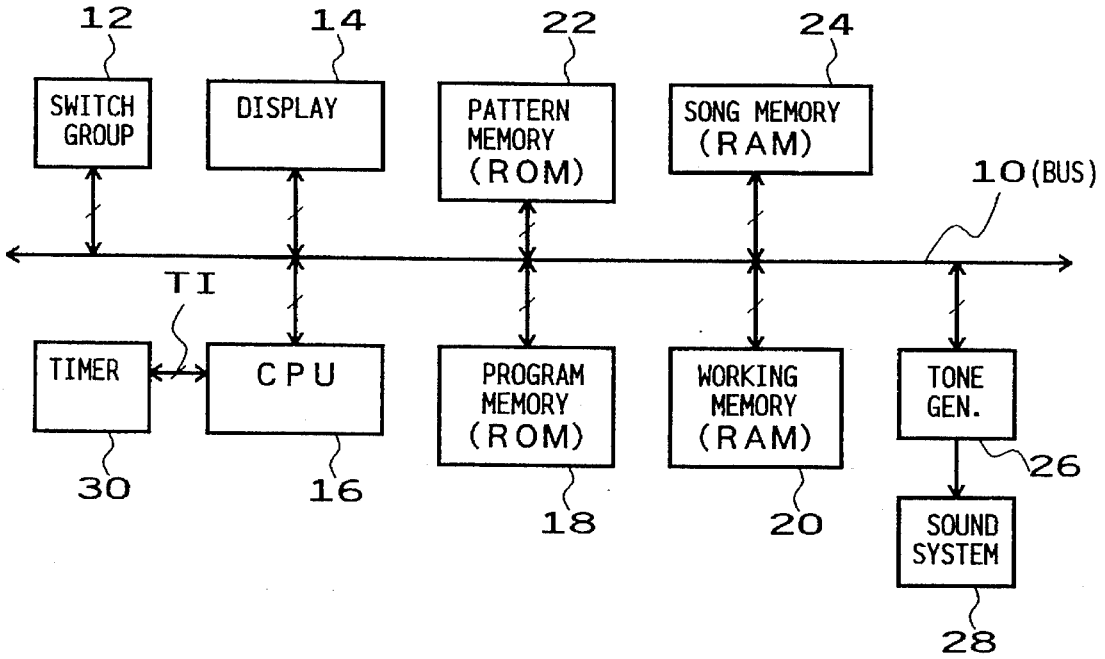
FIG. 1 is a block diagram illustrating the hardware circuit structure of an automatic arrangement device in accordance with an embodiment of the present invention.
FIG. 2 is a diagram illustrating an example formation of a song visually presented on a display of FIG. 1.

Referring first to FIG. 1, there is shown the hardware circuit structure of an automatic arrangement device in accordance with a preferred embodiment of the present invention. In the device, a microcomputer controls various processes such as an automatic arrangement process and an automatic performance process. In the figure, each signal line with a tick drawn therethrough indicates a plurality of physical signal lines.

To a bus 10 are connected a group of switches 12, a display 14, a CPU (Central Processing Unit) 16, a program memory 18, a working memory 20, a pattern memory 22, a song memory 24, a tone generator 26, etc.

The switch group 12 includes a variety of switches provided on an operation panel, and the respective operational states of the switches are detected by scanning etc. to provide operational information thereon. Of the various switches included in the switch group 12, the following are primary switches and keys which are directly associated with the embodiment of the present invention:

(1) Song Selection Switches for selecting a music piece to be composed or arranged by the device;

(2) Arrangement Mode Switch for selecting an arrangement mode;

(3) Start/Stop Switch for instructing a start or stop of an automatic performance;

(4) Group of Pitch Designating Keys for designating a desired pitch for a melody performance;

(5) Group of Chord Designating Keys for designating the root and type (e.g., C major, E minor or the like) of a desired chord;

(6) Ten Key for designating the number of measures of and style number of a music piece to be composed and for setting time information about a melody and a chord; and (7) Group of tone color selection switches for selecting a desired tone color for each of melody, obligato, chord backing and bass parts.

The display 14 is provided for displaying a variety of information about automatic arrangement and automatic performance. For a music piece to be composed in the arrangement mode of the device, the display 14 visually presents input information on a song formation as shown in FIG. 2.

With the illustrated example in FIG. 2, there are displayed, for song No. 3, four performance sections A to D, and the number of measures of and style of each performance section A to D. For instance, for performance section A, "4" is displayed as the number of measures and "3" as the style number. The styles achievable in the embodiment are allotted respective style numbers; e.g., waltz is allotted style number "3".

As will be later described in detail with reference to FIGS. 5 to 9, the CPU 16 carries out various processes for automatic arrangement and automatic performance, in accordance with a set of programs stored in the program memory 18 which is in the form of a ROM (read only memory).

The working memory 20, which is in the form of a RAM (random access memory), contains storage areas that are used as registers and counters as the CPU 16 performs the various processes. The primary registers directly related to the embodiment will be explained later.

The pattern memory 22 is in the form of a ROM, which previously stores therein performance pattern data for the above-mentioned four parts, obligato, chord backing, bass and drum (rhythm) parts. The data storage format in the pattern memory 22 will be described later with reference to FIG. 3.

The song memory 24 is in the form of a RAM, which is capable of storing performance pattern data for the four parts that are mentioned above in connection with the pattern memory 22. The data storage format in the song memory 24 will be described later with reference to FIG. 4.

The tone generator 26 includes a plurality of tone generation channels for generating tone signals corresponding to the five parts, melody, obligato, chord backing, bass and drum parts. The tone signals from these tone generation channels are audibly reproduced or sounded through a sound system 28.

A timer 30 supplies the CPU 16 with timer interrupt command signals TI, which are generated by the timer 30 at such timing corresponding to a ninety-sixth note within a measure. Upon receipt of each timer interrupt command signal TI, the CPU 16 initiates an interrupt process routine.

Figure 3:
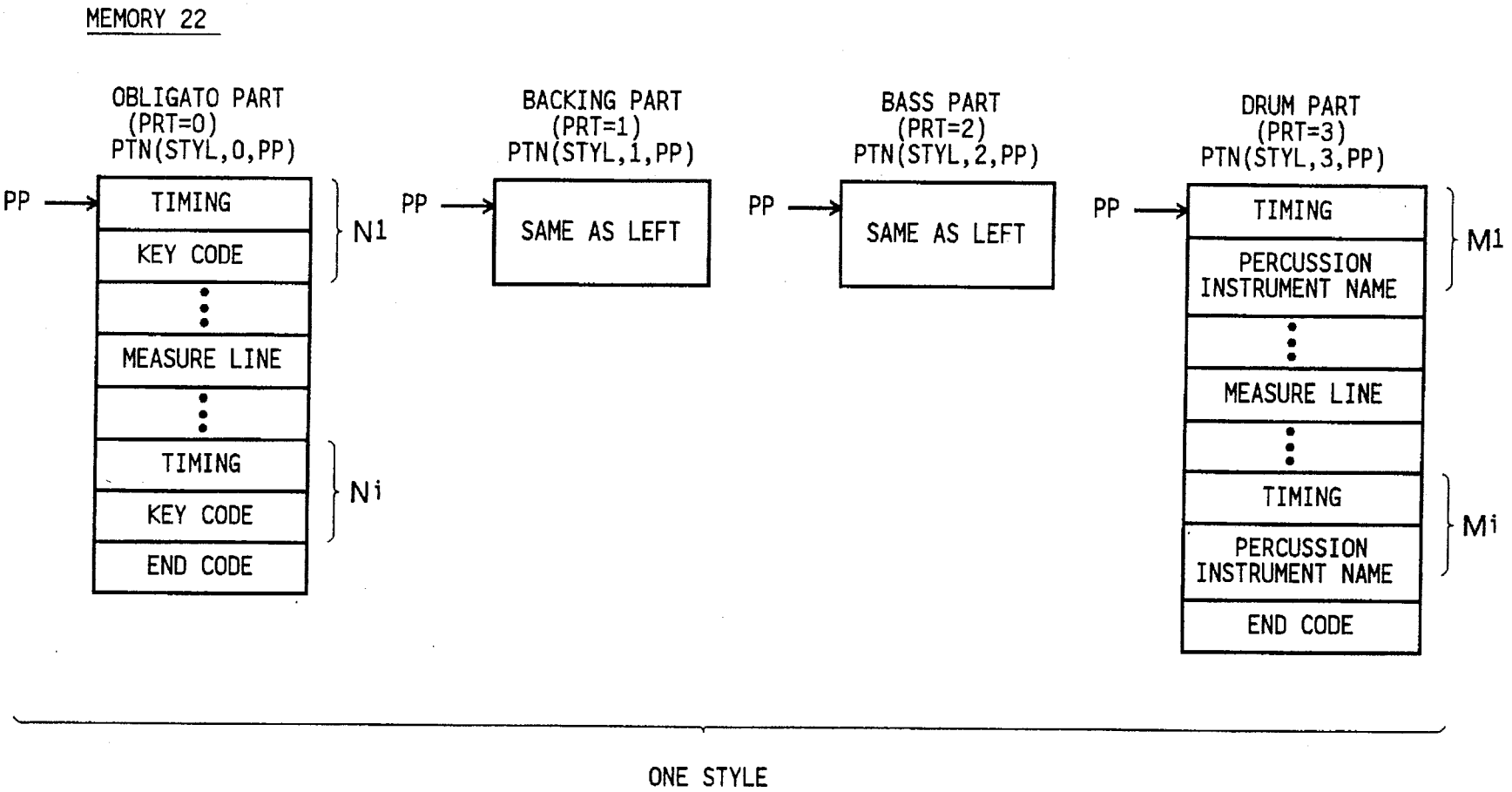
FIG. 3 is a diagram illustrating a format of data stored in a pattern memory of FIG. 1.

FIG. 3 shows the stored data format in the pattern memory 22. In the pattern memory 22, there are previously stored, for each of the styles, performance pattern data PTN that represent the respective performance patterns of the obligato, chord backing, bass and drum parts. The length of the performance pattern for each of the parts corresponds to two measures, for example.

The performance pattern data for the obligato part includes timing data and key code data of each tone $N_1 \ldots N_i$, to be generated and it also includes measure line data corresponding to the end of a first measure and end code data corresponding to the end of a second measure. The timing data represents tone generation timing within a measure by a value that corresponds to a count of the timer interrupt command signals TI (any of 0 to 96 in the case of quadruple time), and the key code data represents the pitch of a tone to be generated.

The performance pattern data for the chord backing and bass parts are both in a format similar to that for the obligato part.

The performance pattern data for the drum part includes timing data and percussion instrument name data of each percussive tone $M_1 \ldots M_i$ to be generated, and it also includes measure line data corresponding to the end of a first measure and end code data corresponding to the end of a second measure. The timing data for the drum part is similar to that for the obligato part, and the percussion instrument name data represents the name of a percussion instrument corresponding to a percussive tone to be generated (drum, cymbal or the like).

Figure 4:
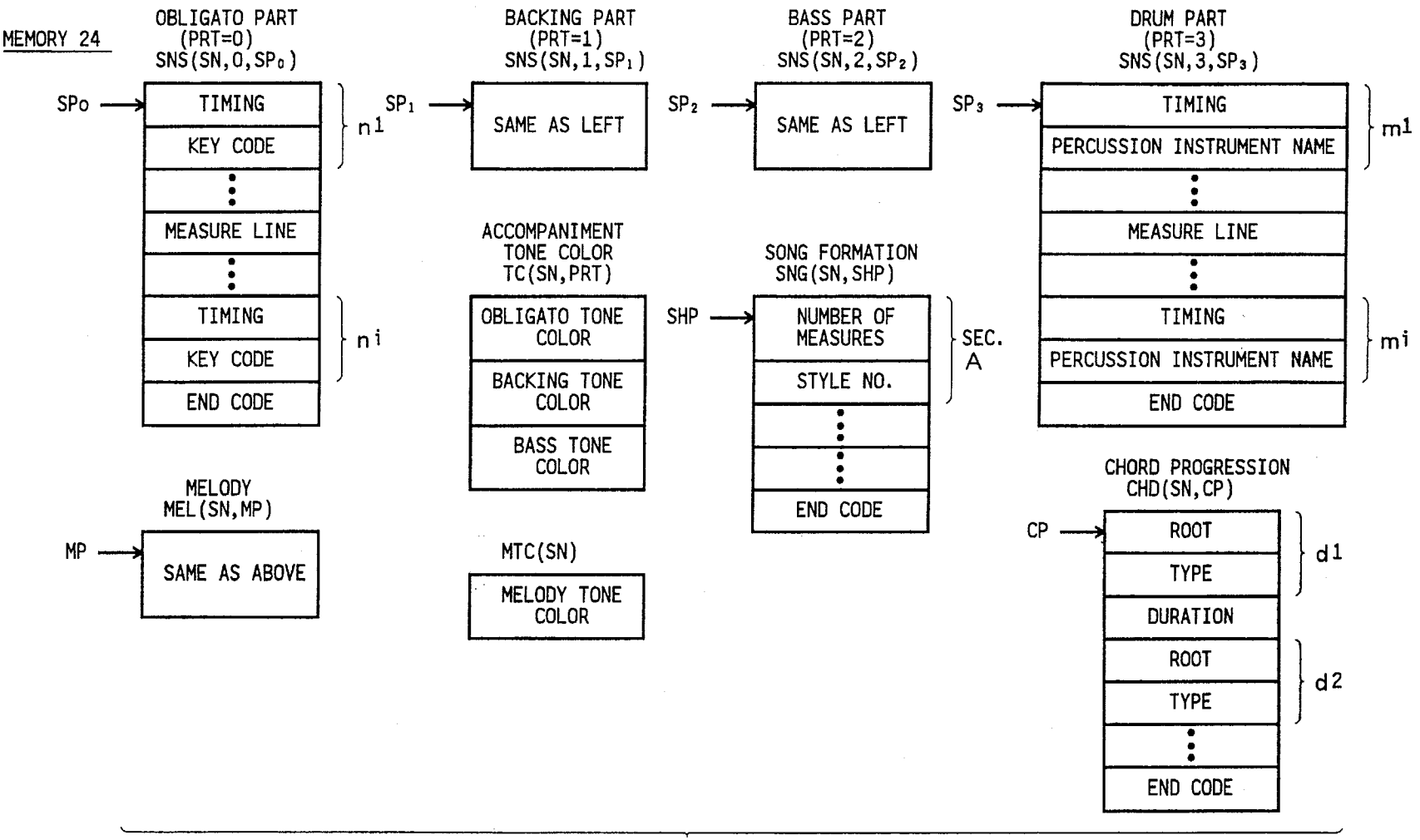
FIG. 4 is a diagram illustrating a format of data stored in a song memory of FIG. 1.

FIG. 4 shows the stored data format in the song memory 24. In this song memory 24, there are stored, for each music piece, music data SNS for the obligato, chord backing, bass and drum parts, music data MEL for the melody part, melody tone color data MTC, accompaniment tone color data TC, song formation data SNG and chord progression data CHD.

The music data for each of the obligato, chord backing, bass and drum parts is composed of time-series combinations of the performance pattern data of the corresponding part sequentially read out from the pattern memory 22. The data formats related to tones $n_1 \ldots n_i$ and percussive tones $m_1 \ldots m_i$ to be generated are substantially similar to those mentioned earlier in relation to FIG. 3. For example, in the case of section A of FIG. 2, music data representing progression of four-measure patterns *3a-3b-3a-3b* is stored in the song memory 24 if first and second measure patterns *3a* and *3b* are stored in the pattern memory 22 as two-measure patterns for style 3.

The music data MEL for the melody part is in a data format similar to that for the obligato part. Each key code data composing the music data is input by the use of the above-mentioned pitch designating key group, and each timing data is input by the use of the above-mentioned ten key.

The accompaniment tone color data TC includes tone color data for the obligato, chord backing and bass parts. The tone colors for the three parts related to the accompaniment tone color data TC and melody tone color related to the melody tone color data MTC are entered via the above-mentioned tone color setting switch group.

The song format ion data SNG includes number-of measure data and style number data for each of sequential sections (such as sections A to D of FIG. 2) and further includes end code data at the end of the data sequence. To explain, by way of example, the data contents for section A of FIG. 2, the number-of measure data indicates a value 4, and the style number data indicates a value 3. These data are input via the ten key.

The chord progression data CHD includes chord root data and chord type data of each of sequential chords $d_1$, $d_2$ . . . and also includes duration data indicative of time intervals between the chords. The chord progression data CHD further includes end code data at the end of the data sequence. The chord root data and chord type data are entered via the chord designating switch group, and the duration data is entered via the ten key.

The following are some of the primary registers in the working memory 20 which are used in the embodiment of the present invention:

(1) Song Number Register SN: A music piece number selected by the song selection switch is set into this register;

(2) Run Flag RUN: This is a one-bit register, with its value 1 indicating that an automatic performance is currently in progress and its value 0 indicating that an automatic performance is currently not in progress;

(3) Tempo Clock Counter CLK: This counter counts the timer interrupt command signals TI from the timer 30 as tempo clock signals. This counter CLK takes on a count value from 0 to 96 within a measure and is reset to 0 upon arrival at value 96;

(4) Number-of-measure Counter M: This counter counts the number of measures when the device is in the arrangement mode:

(5) Number-of-measure Register MJN: In this register is stored number-of-measure data contained in the song formation data SNG read out from the song memory 24 of FIG. 4;

(6) Style Number Register STYL: In this register is stored style number data contained in the song formation data SNG read out from the song memory 24 of FIG. 4;

(7) Part Number Register PRT: Any of part numbers 0 to 3 is stored in this register when data is read out from the pattern memory 22 of FIG. 3 or when processing is performed on data stored in the song memory 24 of FIG. 4. In this case, part number 0 represents the obligato part, 1 the chord backing part, 2 the bass part and 3 the drum part;

(8) Pattern Memory Address Pointer PP: This pointer indicates a readout address in the pattern memory 22, as shown in FIG. 3;

(9) Song Part Address Pointers $SP_0$–$SP_3$: These pointers indicate respective addresses in music data storage section of the song memory 24 which correspond to part numbers 0 to 3, as shown in FIG. 4;

(10) Melody Address Pointer MP: This pointer indicates an address in the melody-part music data storage section in the song memory 24, as shown in FIG. 4;

(11) Song Formation Address Pointer SHP: This pointer indicates an address in the song formation data storage section of the song memory 24, as shown in FIG. 4; and

(12) Chord Progression Address Pointer CP: This pointer indicates an address in the chord progression data storage section of the song memory 24, as shown in FIG. 4.

Figure 5:
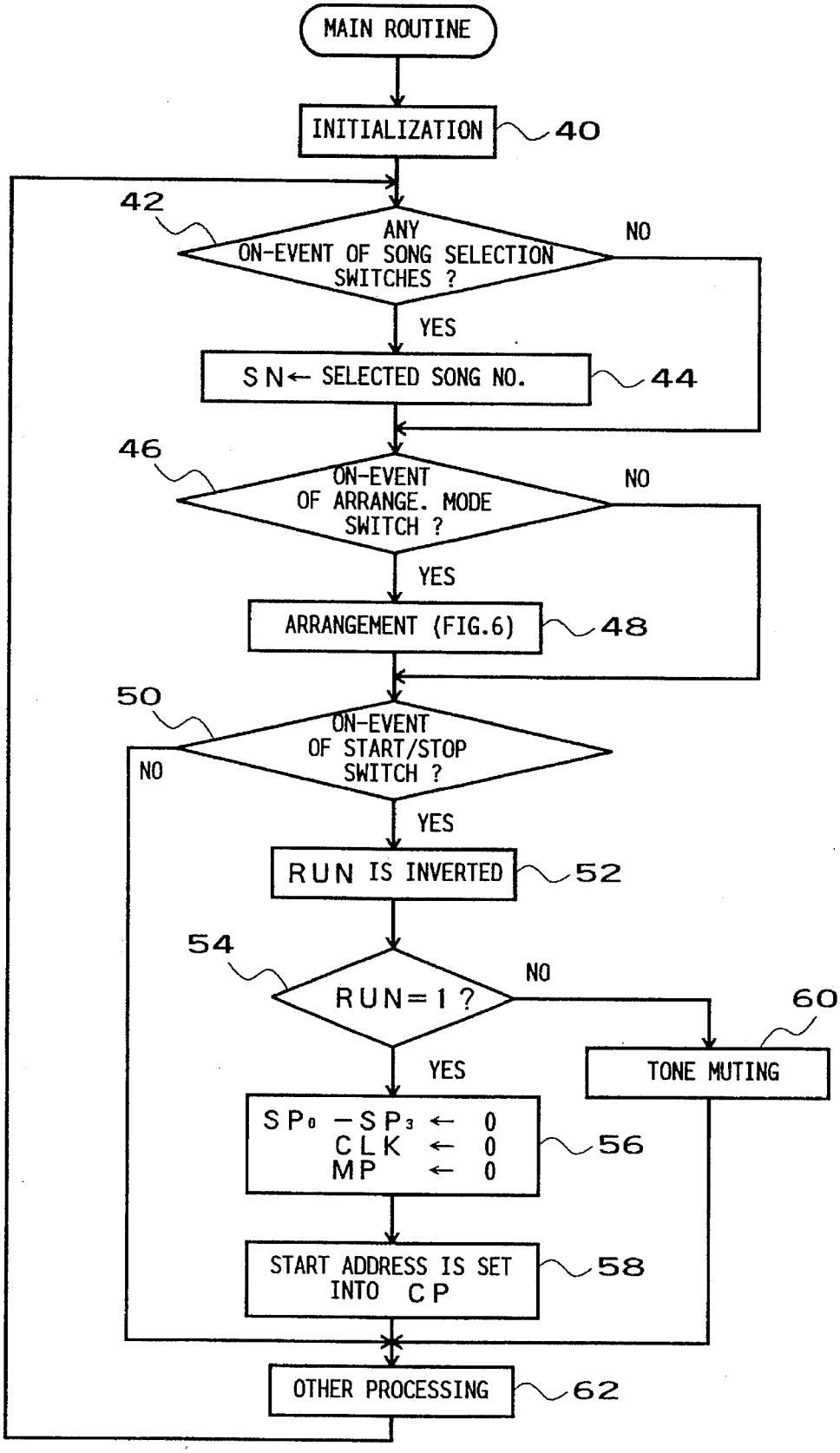
FIG. 5 is a flowchart illustrating a main routine defined by a computer program of the device of FIG. 1.

FIG. 5 shows the operational flow of a main routine that is initiated upon power-on of the automatic arrangement device.

In step 40, an initialization process is performed to initialize the above-mentioned registers and the like. Then, the main routine proceeds to step 42, where a determination is made as to whether there is any on-event of the song selection switches. If answered in the affirmative in this step 42, the routine proceeds to step 44 to set the song number of a selected music piece into the song number register SN. If, on the other hand, the answer is negative in step 44, or when the operation of step 44 is completed, the routine moves to step 46 to further determine whether there is an on-event of the arrangement mode switch. If the answer is affirmative, the routine proceeds to step 48 to carry out an arrangement process subroutine as will be later described in detail in relation to FIG. 6.

If the determination result step 46 is negative, or when the operation of step 48 completed, the main routine moves further to step 50 to determine whether there is an on-event of the start/stop switch. With an affirmative determination, the routine proceeds to step 52 to invert the value set in the flag RUN. That is, if the value in the flag RUN is 0, it is inverted to 1; otherwise, it is inverted to 0. Then, the main routine proceeds to step 54.

In step 54, a determination is made as to whether the value in the flag RUN is 1. If answered in the affirmative, the routine moves further to step 56 in order to set 0 into all of the pointers $SP_0$ to $SP_3$ and MP and the tempo clock counter CLK. After that, the routine proceeds to step 58 in order to set a start address into the chord progression address pointer CP. All these operations are performed in preparation for initiating an automatic performance.

If, however, the answer in step 54 is negative, the routine branches to step 60 to perform a tone muting process; that is, all tone signals being generated through the tone generator 26 are caused to decay. As the result, the automatic performance is stopped. If the answer in step 50 is negative, or when the operation of step 58 or step 60 is completed, the routine reverts to step 42 in order to repeat the operations in this and succeeding steps in the above-mentioned manner.

Figure 6:
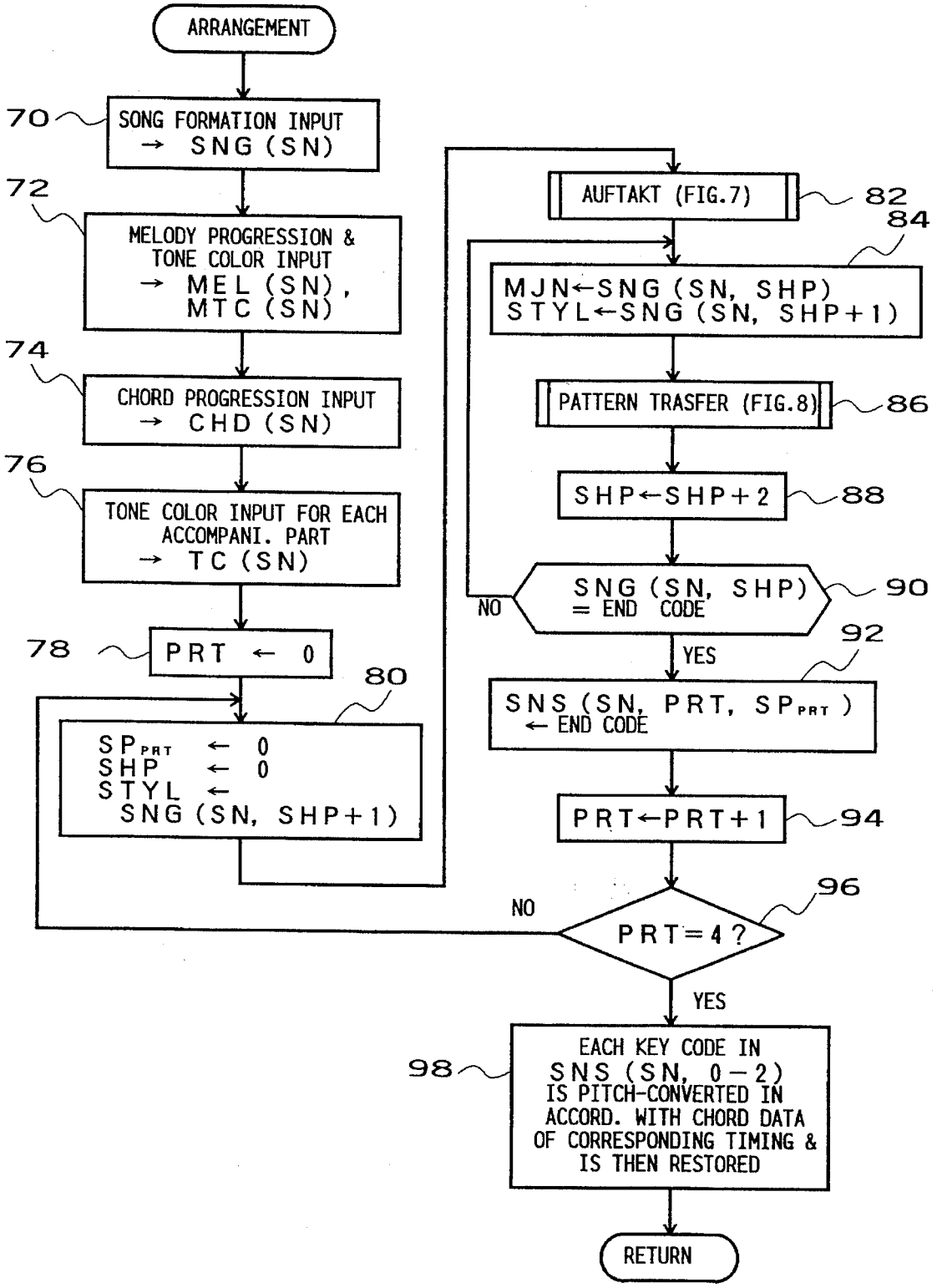
FIG. 6 is a flowchart illustrating an arrangement process subroutine of FIG. 5.

FIG. 6 shows the operational flow of the arrangement process subroutine, where, in steps 70 to 76, various input operations are sequentially performed for the music piece of the song number stored in the song number register SN as will be described below.

First, in step 70, song formation is input. Namely, once the number of measures, style number etc. are input for each section A to D via the ten key, information relative to the input operation is stored into the song formation data storage section SNG (SN) with in the song memory 24 of FIG. 4 which is designated by the song number stored in the song number register SN. The information is also visually presented on the display 14 as previously mentioned in relation to FIG. 2.

Then, in step 72, melody progression and melody tone color are input. Namely, key code data are sequentially input, via the pitch designating key group, in correspondence to note progression of a desired melody, and also timing data are sequentially input via the ten key etc. These input data are stored into the melody-part music data storage section MEL(SN) within the song memory 24 of FIG. 4 which is designated by the song number stored in the song number register SN. Further, once a desired tone color is set via the tone color setting switch group before or after the input of the melody progression data, tone color data representative of the melody tone color is stored into the melody tone color data storage section MTC(SN) within the song memory 24 of FIG. 4 which is designated by the song number stored in the song number register SN.

Next, in step 74, chord progression is input. Namely, the root and type of each desired chord are designated by means of the chord designating switch group and duration values between the chords are designated by means of the ten key. Consequently, these data are stored into the chord progression data storage section CHD(SN) within the song memory 24 of FIG. 4 which is designated by the song number stored in the song number register SN.

After that, in step 76, tone color is input for each of the accompaniment parts. Namely, a desired tone color is set, via the tone color setting switch group, for each of the obligato, chord backing and bass parts. Consequently, these data are stored into the accompaniment tone color data storage section TC(SN) within the song memory 24 of FIG. 4 which is designated by the song number stored in the song number register SN. Subsequently, the subroutine proceeds to step 78.

In step 78, 0 (corresponding to the obligato part) is set into the part number register PRT. Then, the subroutine moves further to step 80, where 0 is set into the pointer $SP_{PRT}$ designated by the part number of the register PRT and 0 is set into the song formation address pointer SHP. Style number data SNG(SN, SHP+1) which is designated by the song number in the register SN and the value in the pointer SHP plus one is read out from the song memory 24 of FIG. 4 and then stored into the style number register STYL. After that, the subroutine moves to step 82.

In step 82, an auftakt process subroutine is performed as will be later described in detail in relation to FIG. 7. In this subroutine, once auftakt is detected on the basis of timing data read out from the melody-part music data storage section MEL(SN) within the song memory 24 of FIG. 4, pattern data of part of a last measure is read out from the pattern memory 22 for each of the parts and stored into the song memory 24 as auftakt data. After that, the subroutine proceeds to step 84.

In step 84, song formation data SNG(SN, SHP) and SNG(SN, SHP+1) for one section are read out from the song memory 24 and then stored into the number-of-measure counter MJN and style number register STYL, respectively. The data SNG(SN, SHP) is number-of-measure data designated by the song number stored in the register SN and the address value indicated by the song formation address pointer SHP, and the data SNG(SN, SHP+1) is style number data stored at the next address to the number-of-measure data. When the subroutine comes to this step 84 for the first time after step 78, song formation data for the first section (section A in the example of FIG. 2) are read out from the song memory 24 and stored into the registers MJN and STYL.

Next, in step 86, a pattern transfer process subroutine is performed as will be later described in detail in relation to FIG. 8. In this subroutine, performance pattern data of the part designated by the part number stored in the register PRT are read out and combined in a time-series fashion so as to form or compose music data for one sect ion (e.g., music data of the obligato part for section A of FIG. 2), which is then stored into the song memory 24. Consequently, after the value of the song formation address pointer SHP is incremented by two in step 88, the subroutine proceeds to step 90.

In step 90, a determination is made as to whether the song formation data SNG(SN, SHP) designated by the song number stored in the register SN and the address value in the pointer SHP is end code data. If the subroutine comes to this step 90 for the first time after step 78, it means that the first section (section A in the example of FIG.2) has been completed, and thus, the data SNG(SN, SLIP) is number-of-measure data of the next section (section B in the example of FIG. 2), so that the determination result in step 90 becomes negative (NO). Accordingly, the subroutine reverts to step 84 in order to repeat the operations in this and succeeding steps in the above-mentioned manner.

By repeating the above-mentioned operations, music piece formation is performed for all the sections (sections A to D in the example of FIG. 2). After the music piece formation is completed in step 86 up to the last section such as section D, the value of the song formation address pointer SHP is incremented by two, so that the song formation data SNG (SN, SHP) becomes end code data. Thus, an affirmative determination result is obtained in step 90, and the subroutine moves to step 92.

In step 92, the end code data is written into the storage area (SN, PRT, $SP_{PRT}$) within the song memory 24 which is designated by the song number stored in the song number register SN, part number stored in the part number register PRT and address value indicated by the pointer $SP_{PRT}$ of the part corresponding to the part number. For instance, when the routine comes to step 92 for the first time after step 78, the end code data is written into a storage area within the memory 24 which is at the next address to the last data of the music data for the obligato part.

Next, in step 94, the value in the part number register PRT is incremented by one. When the subroutine comes to step 94 for the first time after step 78, the value of the register PRT is 1 which indicates the chord backing part. After that, the subroutine proceeds to step 96.

In step 96, a determination is made as to whether the value in the part number register PRT is 4. When the subroutine comes to step 96 for the first time after step 78, the value stored in the register PRT is 1, so that the determination result in this step 96 becomes negative (NO). Accordingly, the subroutine reverts to step 80 in order to repeat the operations in this and succeeding steps in the above-mentioned manner.

By repeating the above-mentioned operations, music piece format ion is performed for each of the chord backing, bass and drum parts. Once the value stored in the part number register PRT is incremented in step 94 by one after end code data is written at the end of the drum-part music data, the value in the register PRT becomes 4. Thus, the determination result in step 96 becomes affirmative (YES), so that the subroutine proceeds to step 98.

In step 98, each key code contained in the music data SNS (SN, 0, 1 or 2) designated by the song number in the register SN and the part number 0, 1 or 2 is converted in terms of pitch in accordance with one of the chord data (root data and type data) stored in the song memory 24 which corresponds in timing to the key code, and the resultant pitch-converted key code is restored into the memory 24. In this case, all the key codes are not pitch-converted: some key codes are left unchanged depending on the nature of the chord data corresponding thereto. After this step 98, the subroutine returns to the main routine of FIG. 5.

Figure 7:
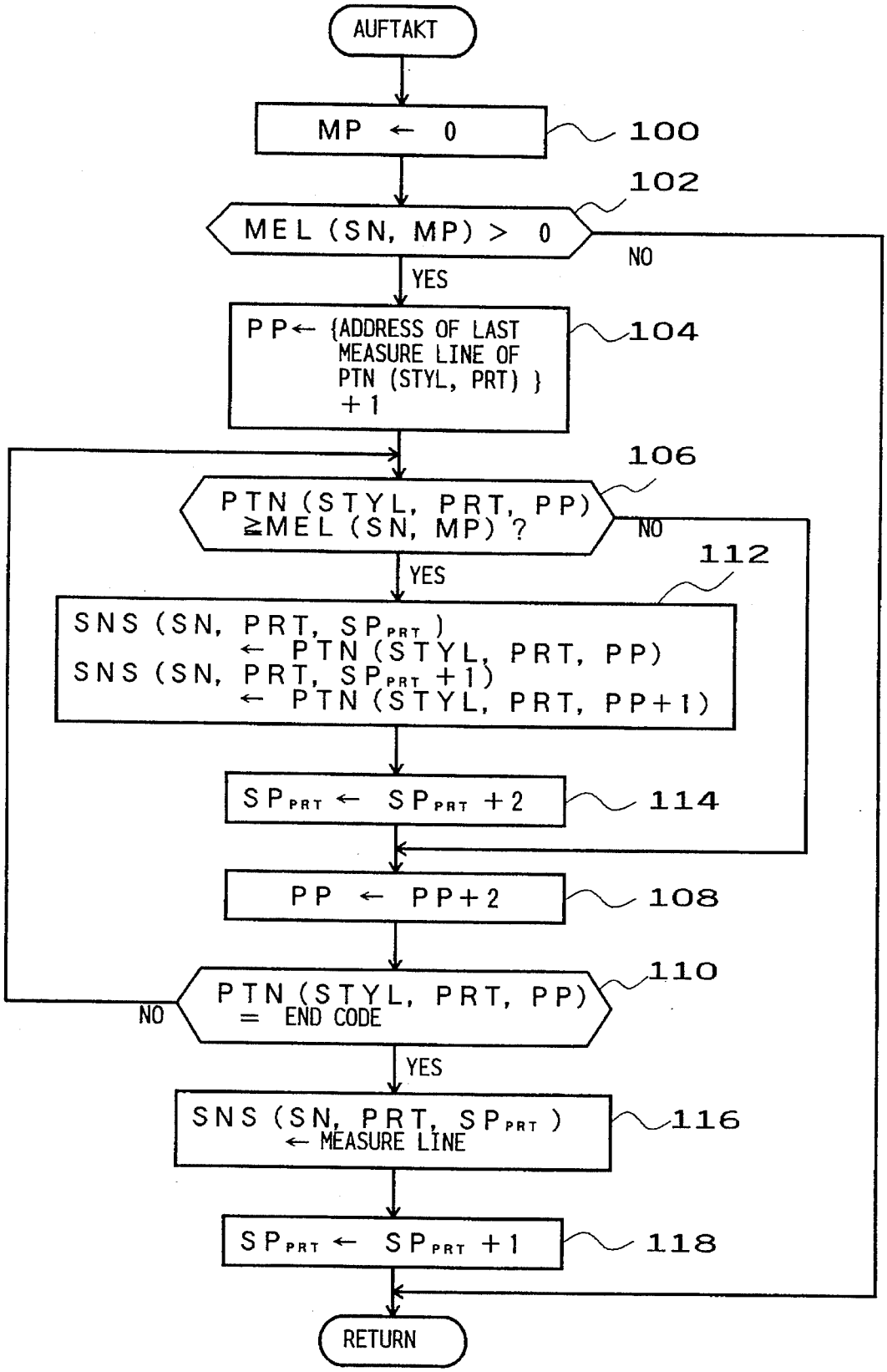
FIG. 7 is a flowchart illustrating an auftakt process subroutine of FIG. 6.

FIG. 7 shows the operational flow of the auftakt process subroutine, where, after setting 0 into the melody address pointer MP, the subroutine proceeds to step 102.

In step 102, a determination is made as to whether a timing value contained in the melody-part music data which is indicated by the song number stored in the song number register SN and the address value indicated by the melody address pointer MP is greater than 0 or not (i.e., whether the timing value indicates auftakt). If answered in the negative in this step, the following operations will not be not necessary, and thus the subroutine returns to the routine of FIG. 6.

If, however, the answer in step 102 is affirmative, then the subroutine proceeds to step 104, in order to set the pattern memory address pointer PP to such a value that is obtained by adding 1 to the address of the last measure line data of performance pattern data PTN(STYL, PRT) within the memory 22 which is designated by the style number stored in the register STYL and part number in the register PRT. The value thus set into the pointer PP indicates the first timing data of the last measure. After step 104, the subroutine moves to step 106.

In step 106, a determination is made as to whether or not timing data PTN(STYL, PRT, PP) stored in the pattern memory 22 which is designated by the style number in the register STYL, part number in the register PRT and address value indicated by the pointer PP is equal to or greater than the timing value (auftakt timing value) indicated by the timing data (SN, MP) previously mentioned in relation to step 102. When the subroutine comes to step 106 for the first time after the address of the first timing data in the last measure is set into the pattern memory address pointer PP, the determination result in step 106 becomes negative, and thus the subroutine proceeds to step 108.

In step 108, the address value in the pattern memory address pointer PP is incremented by two. Then, the subroutine moves further to step 110 in order to determine whether the data PTN(STYL, PRT, PP) stored in the memory 22 which is designated by the style number in the register STYL, part number in the register PRT and address value indicated by the pointer PP is end code data. When the subroutine comes to step 110 for the first time after step 104, the data PTN(STYL, PRT, PP) is the second timing data in the last measure, and thus the determination result in step 110 becomes negative. In such a case, the subroutine reverts to step 106 in order to repeat the operations in this and succeeding steps in the above-mentioned manner.

By repeating the operations a plurality of times, the determination result in step 106 becomes affirmative, and the subroutine is directed to step 112. In step 112, timing data PTN(STYL, PRT, PP) and next key code data or percussion instrument name data PTN(STYL, PRT, PP+1) are read out from the pattern memory 22 and are then written into the storage area SNS(SN, PRT, $SP_{PRT}$) of the song memory 24 which is designated by the song number in the register SN and part number of the register PRT and into the next storage area SNS(SN, PRT, $SP_{PRT}$+1), respectively. In this manner, auftakt data for one timing are written. After that, the subroutine moves to step 114.

In step 114, the value in the pointer $SP_{PRT}$ is incremented by two. Then, after incrementing the value in the pattern memory address pointer PP by two, the subroutine proceeds to step 110. In step 110, a determination is made again as to whether or not the data PTN(STYL, PRT, PP) is end code data. If answered in the negative, the subroutine reverts to step 106 in order to repeat the operations in this and succeeding steps. As the result, auftakt data for plural timings are stored into the song memory 24.

If the answer in step 110 is affirmative, the subroutine moves further to step 116, in order to write measure line data into storage area SNS(SN, PRT, $SP_{PRT}$) of the memory 24 which is designated by the song number stored in the register SN, part number stored in the register PRT and address value indicated by the pattern memory address pointer PP. As the result, the measure line data is stored at the end of the auftakt data. Then, the program returns to the routine of FIG. 6 after incrementing the pointer $SP_{PRT}$ by one.

Figure 8:
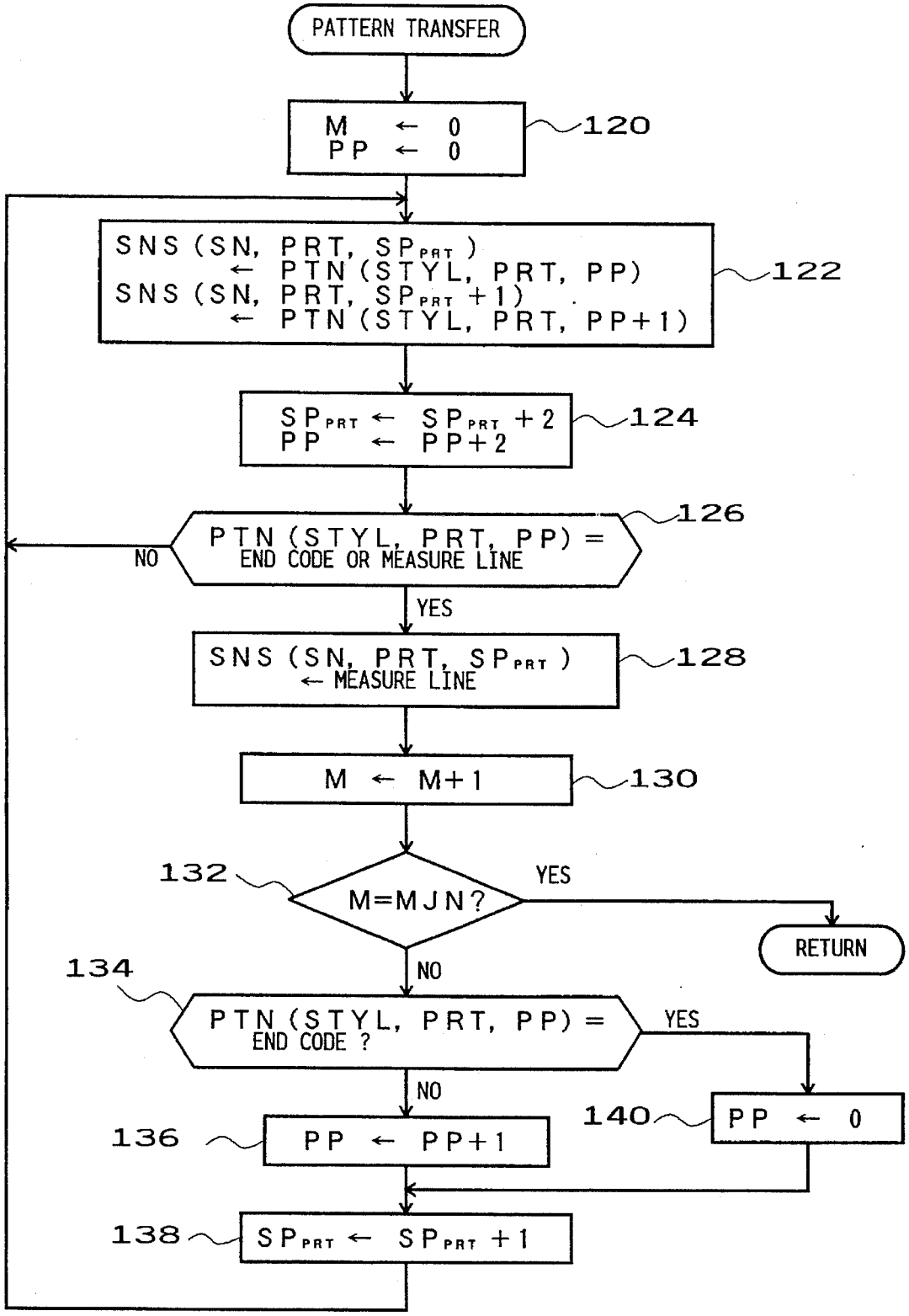
FIG. 8 is flowchart illustrating a pattern transfer process subroutine of FIG. 6.

FIG. 8 shows the operational flow of the pattern transfer process subroutine, where, first in step 120, both the number-of-measure counter M and the pattern memory address pointer PP are set to 0. Then, the subroutine proceeds to step 122.

In step 122, timing data PTN(STYL, PRT, PP) and key code data or percussion instrument name data PTN(STYL, PRT, PP+1) at the next address are read out from the pattern memory 22 and then are written into the storage area SNS(SN, PRT, $SP_{PRT}$) of the song memory 24 and storage area (SN, PRT, $SP_{PRT}$+1) at the next address. In the case where auftakt data has been stored into the song memory 24 in steps 104 to 112 of FIG. 7, data write operation is performed, in step 122, from the next address to the measure line data written in step 114.

Next, in step 124, the address values in the pointers $SP_{PRT}$ and PP are both incremented by two. Then, the subroutine proceeds to step 126 to determine whether the data PTN(SN, PRT, PP) is end code data or measure line data. When the subroutine comes to step 126 for the first time after 122, it means that data on a first tone in the first measure of the performance pattern has just been read out, and thus the determination result in step 126 becomes negative. In such a case, the subroutine reverts to step 122 to repeat the operations in this and succeeding steps in the above-mentioned manner.

By repeating the above-mentioned operations a plurality of times, the data PTN(SN, PRT, PP) becomes measure line data at the end of the first measure of the performance pattern, so that the determination result in step 126 becomes affirmative and the subroutine moves to step 128.

In step 128, the measure line data is written into the storage area SNS(SN, PRT, $SP_{PRT}$) of the song memory 24. Consequently, the measure line data is written at the end of one-measure music data. After that, the subroutine proceeds to step 132 after incrementing the count value of the number-of-measure counter M in step 130.

In step 132, a determination is made as to whether the count value of the counter M is equal to the stored value of the number-of-measure register MJN (i.e., whether data transfer has been terminated for the designated number of measures). If the designated number of measures is 4 as in the case of section A of FIG. 2, a negative determination result is obtained in step 132 when the count value of the counter M has become 1 in step 130, and then the subroutine proceeds to step 134.

In step 134, a further determination is made as to whether or not the data PTN(STYL, PRT, PP) is end code data. When the subroutine comes to step 134 for the first time after the count value of the counter M has become 1 as in the above-mentioned case, the data PTN(STYL, PRT, PP) is measure line data. Thus, the determination result in step 134 becomes negative, and the subroutine moves to step 136.

In step 136, the value of the pattern memory address pointer PP is incremented by one. Then, after incrementing the value of the pointer $SP_{PRT}$ by one in step 138, the subroutine reverts to step 122 to repeat the operations in this and succeeding steps in the above-mentioned manner.

When the subroutine comes to step 134 after the count value of the number-of-measure counter M has become 2, an affirmative determination result is obtained in step 134, so that the subroutine goes to step 140 to reset the pattern memory address pointer PP to zero. In this manner, the subroutine repeats its data readout operation from the beginning of the first one of the two-measure patterns.

After step 140, the subroutine increments the value of the pointer $SP_{PRT}$ by one and then reverts to step 122 to repeat the operations in this and succeeding steps in the above-mentioned manner. By repeating the such operations a plurality of times, the determination result in step 132 becomes affirmative, and thus the subroutine returns to the routine of FIG. 6. In the case of section A of FIG. 2, an affirmative determination result is obtained in step 132 once the count value of the counter M has become 4.

Figure 9:
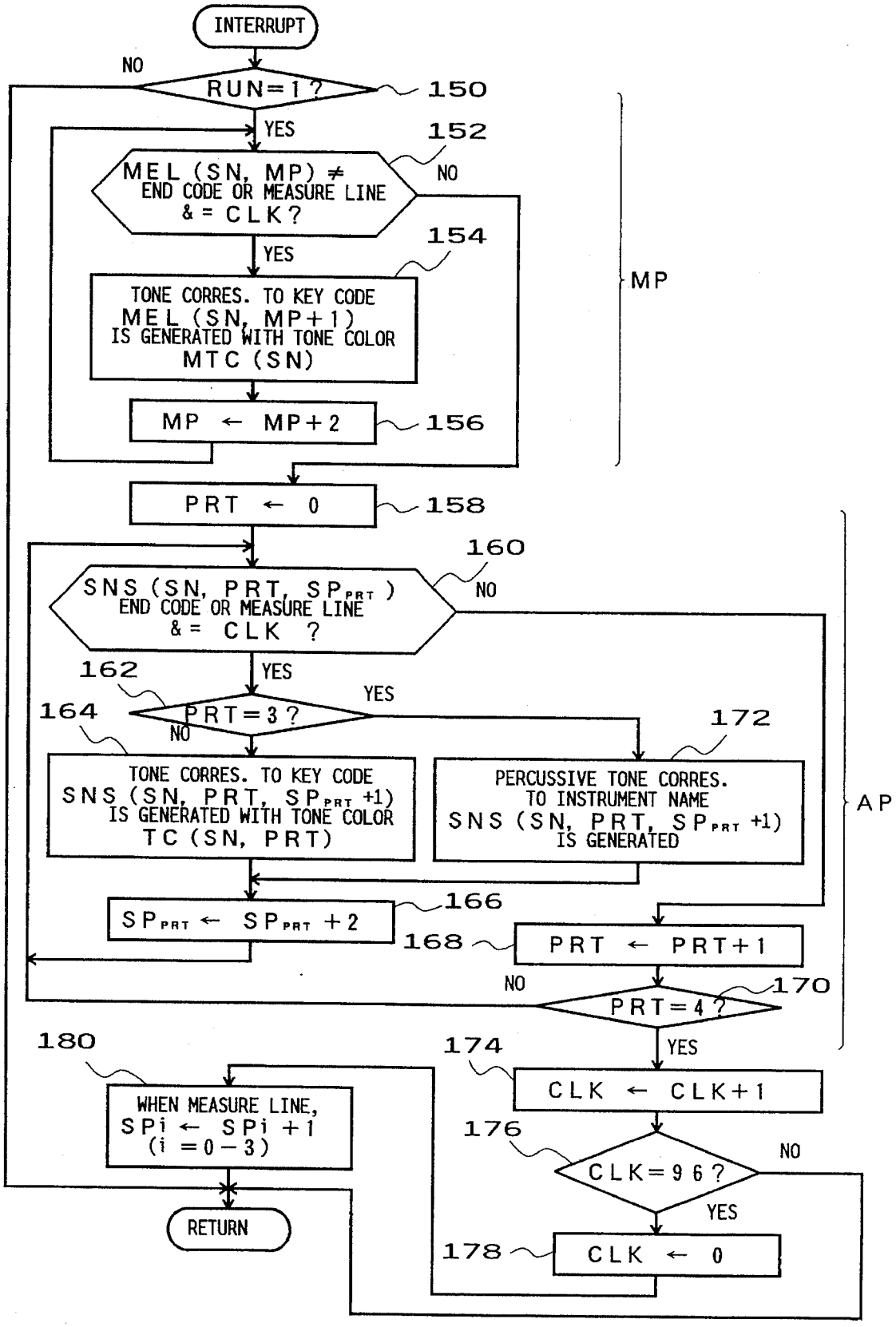
FIG. 9 is a flowchart illustrating an interrupt process routine.

FIG. 9 shows the operational flow of the interrupt routine, which includes various operations for automatic performance and is triggered by the interrupt command signal TI from the timer 30.

In step 150, it is determined whether the value in the flag RUN is 1 or not. If answered in the negative, the following operations will not be necessary, and the routine returns to the main routine of FIG. 5.

If answered in the affirmative in step 150, then the routine performs melody reproduction operations in steps 152 to 156. First, in step 152, a determination is made as to if the melody-part music data MEL(SN, MP) in the song memory 24 designated by the song number stored in the register SN and address value indicated by the number-of-measure pointer MP is not end code data or measure line data and is also equal to the timing value of the tempo clock counter CLK. If an affirmative determination result is obtained in step 152, the routine proceeds to step 154.

In step 154, the tone generator 26 is caused to generate a tone signal that corresponds to the key code data MEL(SN, MP+1) at the next address to the data MEL(SN, MP). At this time, the tone color of the tone signal is set in accordance with melody tone color data MTC(SN) stored in the song memory 24 which is designated by the song number stored in the register SN. Then, the routine moves to step 156.

In step 156, the value of the melody address pointer MP is incremented by two. Then, the subroutine reverts to step 152 to again make the above-mentioned determination. If the answer in step 152 is affirmative, a tone signal is generated in step 154 in the above-mentioned manner. In this manner, it is possible to substantially simultaneously generate plural melody tones of the same timing.

If, on the other hand, the answer in step 152 is negative, the routine performs accompaniment reproduction operations in steps 158 to 170. First, in step 158, part number 0 (corresponding to the obligato part) is set into the part number register PRT. Then, the routine proceeds to step 160.

In step 160, a determination is made as to if the data SNS(SN, PRT, $SP_{PRT}$) in the song memory 24 which is designated by the song number in the register SN, part number in the register PRT and address value in the pointer $SP_{PRT}$ of the part-number corresponding part is not end code data or measure line data and is also equal to the timing value of the tempo clock counter CLK. If answered in the affirmative, the routine moves to step 162.

In step 162, a determination is made as to whether the value stored in the part number register PRT is 3 (corresponding to the drum part). When the routine comes to step 158 for the first time after 158, the value of the register PRT is 0, and thus the answer in step 162 becomes negative. In such a case, the routine proceeds to step 164.

In step 164, the tone generator 26 is caused to generate a tone signal that corresponds to the key code data SNS(SN, PRT, $SP_{PRT}$+1) at the next address to the timing data MEL(SN, PRT, $SP_{PRT}$). At this time, the tone color of the tone signal is set in accordance with the accompaniment tone color data (SN, PRT) stored in the song memory 24 which is designated by the song number stored in the register SN and part number stored in the register PRT.

Then, the routine moves to step 166, where the value of the pointer $SP_{PRT}$ is incremented by two. Then, the routine reverts to step 160 to again make the above mentioned determination. If the answer in step 160 is affirmative, a tone signal is generated in step 164 in the above-mentioned manner. In this way, it is possible to substantially simultaneously generate plural tones of the same timing.

If, on the other hand, the answer in step 160 is negative, the routine branches to step 168 to increment the value stored in the part number register PRT. It is then determined whether the value in the register PRT is 4 (i.e., whether tone generation has been terminated for all the accompaniment parts). When the routine comes to step 168 for the first time after step 158, the value of the register PRT is 1, and thus the determination result in step 170 becomes negative. In such a case, the routine reverts to step 160 to repeat the operations in this and succeeding steps in the above-mentioned manner. In this way, tone generation processes are performed for the chord backing part of part number 1 and for the bass part of part number 2.

Once the value in the register PRT is incremented by one after the tone generation process for the bass part, the value becomes 3. When the routine comes to step 162 in this condition, the determination result in step 162 becomes affirmative, and the routine proceeds to step 172.

In step 172, the tone generator 26 is caused to generate a percussive tone signal corresponding to the percussive instrument name data SNS(SN, PRT, $SP_{PRT}$ 11). Then, the routine reverts to step 160 by way of step 166, so as to cause the tone generator 26 to generate another percussive tone signal in step 172 if there is any other percussive tone to be generated at the same timing.

After that, once the answer in step 160 becomes negative and the value in the part number register PRT is incremented by one in step 168, the value becomes 4. Thus, the determination result in step 170 becomes affirmative, and the routine proceeds to step 174.

In step 174, the count value of the tempo clock counter CLK is incremented by one. Then, the routine moves to step 176 so as to determine whether the count value of the register CLK is 96 (i.e., whether one measure has finished). If answered in the negative, the routine returns to the main routine of FIG. 5.

If, however, the answer in step 176 is affirmative, the routine moves to step 178 to reset the tempo clock counter CLK to zero. Then, the routine proceeds to step 180, where, if the data SNS(SN, PRT, $SP_{PRT}$) is measure line data, the respective values in the pointers $SP_0$ to $SP_3$ are all incremented by one. After that, the routine returns to the main routine of FIG. 5.

It should be understood that the present invention is not limited to the above-described embodiment and various modifications are possible without departing from the spirit of the present invention. For instance, the following modifications are possible:

(1) Although, in the above-described embodiment, the auftakt process subroutine is performed upon detection of auftakt on the basis of the melody-part music data, this auftakt process routine may be performed in response to the user's specific instructions;

(2) The performance pattern may be input optionally by the user;

(3) Music piece composed in accordance with the principle of the present invention may be recorded on any suitable recording medium and then may be automatically performed at places different from the place where it was composed; and (4) The place to which is added a partial pattern of a length less than one measure is not necessarily limited to the beginning of a music piece as in the above-described embodiment and may also be the end or other optionally designated section of a music piece.

The present invention as has been thus far described can make auftakt music pieces and thus can provide a wide variety of music performances. Further, by detecting auftakt on the basis of melody performance data to make auftakt music piece, the present invention can provide a convenient way to composing music pieces without requiring substantial labor and time.

What is claimed is:

1. An automatic arrangement device comprising:

pattern storage means for storing plural different performance pat terns, each of the performance patterns being of one or more measures;

composition means for selecting and reading out desired ones of the performance patterns from said pattern storage means to thereby make a music piece comprising time-series combinations of the selected performance patterns;

instruction means for instructing to make the music piece in the form of an auftakt music piece form; and auftakt pattern addition means for, in accordance with instruction from said instruction means, reading out a part of a one-measure performance pattern from said pattern storage means and adding the read-out part of the one-measure performance pattern to the beginning of the music piece to be made by said composition means.

2. An automatic arrangement device as defined in claim 1 wherein said instruction means includes start position designation means for designating a specific time position halfway within a measure at which a music piece is to start, and wherein, as said part of the one-measure performance pattern, said auftakt pattern addition means extracts and reads out from said pattern storage means a part of one of the performance patterns that starts at the designated time position.

3. An automatic arrangement device as defined in claim 2 wherein said start position designation means designates the specific time position on the basis of entry of numerical value data indicative of an optional time position within a measure.

4. An automatic arrangement device as defined in claim 2 wherein said start position designation means designates the specific time position, in synchronism with running of an automatic performance tempo clock.

5. An automatic arrangement device as defined in claim 1 wherein said auftakt pattern addition means reads out from said pattern storage means a part of a last-measure performance pattern of the performance patterns selected by said composition means and adds the read-out part of the last-measure performance pattern to the beginning of the music piece made by said composition means.

6. An automatic arrangement device as defined in claim 1 wherein said composition means makes, for each of performance parts to be simultaneously played, a music piece comprising time-series combinations of the performance patterns, and said auftakt pattern addition means reads out from said pattern storage means a part of a last-measure performance pattern of the performance patterns for each said performance part and adds the read-out part of the last-measure performance pattern to the beginning of the music piece for each said part made by said composition means.

7. An automatic arrangement device as defined in claim 1 which further comprises means for performing a melody part, and wherein the music piece made by said composition means is performed as an automatic accompaniment part together with the melody part.

8. An automatic arrangement device as defined in claim 7 where in said instruction means including detection means for detecting that performance of the melody part is in the form of an auftakt music piece, and wherein, in response to detection by said detection means, said instruction means instructs said composition means to make the music piece in the form of an auftakt music piece.

9. An automatic arrangement device as defined in claim 1 which further comprises memory means for storing data on the music piece made by said composition means.

10. An automatic arrangement device as defined in claim 9 which further comprises means for audibly performing the music piece made by said composition means, in real time or by reproductively reading out the data on the music piece stored in said memory means.

11. An automatic arrangement device comprising:

first storage means for storing plural different performance patterns, each of the performance patterns being of one or more measures;

composition means for selecting and reading out desired ones of the performance patterns from said first storage means to thereby make a music piece comprising time-series combinations of the selected performance patterns:

means for providing performance data for a melody part;

detection means for, on the basis of the performance data for the melody part, detecting that the melody starts in auftakt form;

auftakt pattern addition means for, in accordance with instruction by said detection means, reading out a part of a certain one-measure performance pattern from said first storage means and adding the read-out part of the one-measure performance pattern to the beginning of the music piece to be made by said composition means; and second storage means for storing data on the music piece made by said composition means.

12. An automatic arrangement device comprising:

pattern storage means for storing plural different performance patterns, each of the performance patterns being of one or more measures;

composition means for selecting and reading out desired ones of the performance patterns from said pattern storage means to thereby make a music piece comprising time-series combinations of the selected performance patterns;

designation means for designating a performance section having a length less than one measure; and partial pattern addition means for, in accordance with designation by said designation means, reading out a part of a certain one-measure performance pattern from said pattern storage means and adding the read-out part of the one-measure performance pattern to the beginning of the music piece to be made by said composition means.

* * * * *